US006369873B1

(12) United States Patent
Levy et al.

(10) Patent No.: US 6,369,873 B1
(45) Date of Patent: Apr. 9, 2002

(54) THERMAL PROCESSING SYSTEM AND METHOD INCLUDING A KIOSK

(75) Inventors: David H. Levy; Richard P. Szajewski; Mark E. Irving; Lyn M. Irving, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/592,836

(22) Filed: Jun. 13, 2000

(51) Int. Cl.[7] ..... G03B 27/32; G03B 27/52; G03B 17/24; G03B 13/00; G03C 11/00

(52) U.S. Cl. ..... 355/27; 355/40; 396/319; 396/575; 430/21; 430/363

(58) Field of Search ..... 355/27, 40; 396/319, 396/575; 430/21, 363

(56) References Cited

U.S. PATENT DOCUMENTS

| | | | |
|---|---|---|---|
| 4,021,240 | A | 5/1977 | Cerquone et al. |
| 4,052,732 | A | 10/1977 | Meadows |
| 4,148,575 | A | 4/1979 | Siryj |
| 4,198,145 | A | 4/1980 | Scott |
| 4,293,212 | A | 10/1981 | Siryj et al. |
| 4,358,192 | A | 11/1982 | Goldberg et al. |
| 4,371,246 | A | 2/1983 | Siryj |
| 4,832,275 | A | 5/1989 | Robertson |
| 4,834,306 | A | 5/1989 | Robertson et al. |
| 4,903,057 | A | 2/1990 | Yamamoto et al. |
| 5,113,351 | A | 5/1992 | Bostic |
| 5,266,805 | A | 11/1993 | Edgar |
| 5,465,155 | A | 11/1995 | Edgar |
| 5,519,510 | A | 5/1996 | Edgar |
| 5,563,717 | A | 10/1996 | Koeng et al. |
| 5,587,767 | A | 12/1996 | Islam et al. |
| 5,627,016 | A | 5/1997 | Manico |
| 5,644,647 | A | 7/1997 | Cosgrove et al. |
| 5,649,260 | A | 7/1997 | Wheeler et al. |

(List continued on next page.)

FOREIGN PATENT DOCUMENTS

| | | |
|---|---|---|
| EP | 0 234 833 A2 | 2/1987 |
| EP | 0 741 327 A1 | 11/1996 |
| JP | 11-237682 | 8/1999 |
| WO | 98/25399 | 12/1997 |
| WO | 98/31142 | 12/1997 |
| WO | 98/34397 | 1/1998 |
| WO | 99/40729 | 1/1999 |
| WO | 99/43148 | 2/1999 |
| WO | 99/43149 | 2/1999 |
| WO | 99/42954 | 10/1999 |

OTHER PUBLICATIONS

Research Disclosure vol. 170,6/78, Item #17029 and vol. 299, 3/89, Item #29963 and Limoges 176,233 (1978).

*Primary Examiner*—Russell Adams
*Assistant Examiner*—Khaled Brown
(74) *Attorney, Agent, or Firm*—David A. Novais

(57) ABSTRACT

A thermal processing kiosk for processing thermal film provides multiple processing options for a user. The kiosk includes a user control in the form of a touchscreen to permit the user to enter processing instructions and/or information. The thermal kiosk is adapted to accept exposed film for processing and printing in accordance with the processing instructions. In one feature of the invention, a user can prepay for processing of the film at the time of purchase of the film. The pre-paid status can be provided on the film by a marker or identifier on the cassette or the film. This helps to simplify the user interaction at the kiosk when the user submits the exposed film to the kiosk for processing. In further features of the invention, the processing flow in the thermal kiosk can be adapted to provide for rapid processing and the kiosk can include a display to permit a user to preview images prior to printing.

18 Claims, 5 Drawing Sheets

U.S. PATENT DOCUMENTS 5,664,253 A 9/1997 Meyers
5,667,944 A 9/1997 Reem et al.
5,698,365 A 12/1997 Taguchi et al.
5,790,277 A 8/1998 Edgar
5,799,220 A 8/1998 Zander
5,903,789 A 5/1999 Zander et al.
5,988,896 A 11/1999 Edgar
6,021,277 A 2/2000 Sowinski et al.
6,048,110 A 4/2000 Szajewski et al.
6,062,746 A 5/2000 Stoebe et al.
6,242,166 B1 * 6/2001 Irving et al. ..... 430/351

* cited by examiner

THERMAL PROCESSING SYSTEM AND METHOD INCLUDING A KIOSK

FIELD OF THE INVENTION

The present invention relates to a thermal processing system and method for processing thermally developable film which includes a kiosk.

BACKGROUND OF THE INVENTION

In the conventional practice of color photography, silver halide film is developed by a chemical technique requiring several steps consisting of latent image developing, bleaching, fixing and washing with the active reagents supplied in dilute solutions. While this technique has been perfected over many years and results in exceptional images, the technique requires the delivery and disposal of several chemicals and precise control of times and temperatures of development. Further, because of the mechanical constraints inherent in a wet solution process, the conventional silver halide chemical development technique is not particularly suitable for utilization with compact developing apparatuses. Nevertheless, attempts to provide convenient processing in customer oriented kiosks have been described by Sabbagh in EPO Published Application 0,234,833; by Bostic in U.S. Pat. No. 5,113,351; by Manico in U.S. Pat. No. 5,627,016 and by Meyers in U.S. Pat. No. 5,664,253. These approaches have not proven to be viable because of the problems mentioned above. Further, the chemical technique which is a wet processing technique is also not easily performed in the home or small office.

Imaging systems that do not rely on conventional wet processing have received increased attention in recent years. Photothermographic imaging systems have been employed for producing silver images. Typically, these imaging systems have exhibited very low levels of radiation-sensitivity and have been utilized primarily where only low imaging speeds are required. A method and apparatus for developing a heat developing film is disclosed in U.S. Pat. No. 5,587,767 to Islam et al. Summaries of photothermographic imaging systems are published Research Disclosure, Volume 170, June 1978, Item 17029, and Volume 299, March 1989, Item 29963. Other heat development color photographic materials have been disclosed, for example, in U.S. Pat. No. 4,021,240 to Cerquone et al. and U.S. Pat. No. 5,698,365 to Tuguchi et al.

In a related area, commercial products such as Color Dry Silver supplied from Minnesota Mining and Manufacturing Company and Pictography™ and Pictrostat™ supplied by Fuji Film Co., Ltd. that allow for the convenient production of prints suitable for direct viewing without further magnification have been on the market. These products however do not provide for the convenient development processing of films formatted for use in hand-held cameras because such films require high magnification before they are suitable for viewing. The processes and products of these manufacturers are incompatible with that need. An apparatus for thermal development that enables the use of a thrust cartridge is disclosed by Szajewski at al in U.S. Pat. No. 6,048,110 and by Stoebe et al. in U.S. Pat. No. 6,062,746.

There remains a need for a user friendly arrangement for processing film that is convenient, rapid and gives the consumer multiple processing options.

SUMMARY OF THE INVENTION

The present invention therefore provides for a thermal processing system and method which incorporates a multifunctional kiosk, is user friendly and facilitates image processing.

The present invention relates to a thermal processing kiosk which comprises a user interface control for inputting information; an opening adapted to accept a film cassette containing exposed thermal film therein; a thermal processor for processing said exposed thermal film at least in accordance with the information to develop images on the film; and a scanner for scanning the images to create a digital image record file of the images.

The present invention further relates to an image processing method which comprises the steps of: purchasing photographic film and paying for processing of the film prior to exposure of the purchased film; and associating an identifier with the photographic film indicating that processing for the film has been pre-paid.

The present invention further relates to a photographic film cassette having unexposed film therein, wherein an identifier is associated with at least one of the cassette or the film to indicate that processing for the unexposed film in the cassette has been pre-paid.

DETAILED DESCRIPTION OF THE INVENTION

Figure 1:
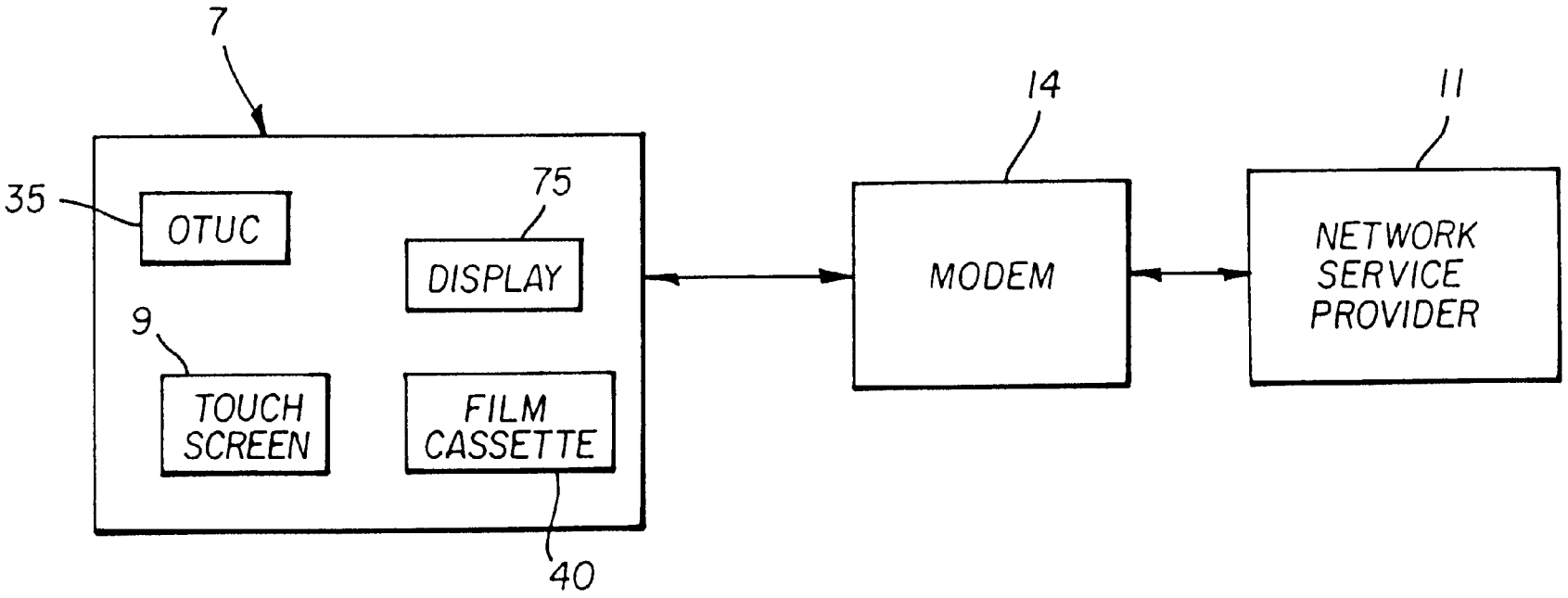
FIG. 1 is a schematic illustration of a thermal processing kiosk in accordance with the present invention.

Referring now to the drawings, wherein like reference numerals represent identical or corresponding parts throughout the several views, FIG. 1 schematically illustrates a kiosk 7 for processing thermal film. Kiosk 7 includes a touch screen control 9 for consumer input. Touch screen control 9 eliminates the need for an additional keypad and promotes ease of operation.

Any thermal film that provides satisfactory images can be utilized in the present invention. Typical films are full colored thermal films such as disclosed in U.S. Pat. No. 5,698,365. A typical film provides light sensitive silver halides, compounds that form dyes, compounds that release dyes, couplers as dye donating compounds, reducing agents, and binders on supports.

As also shown in FIG. 1, kiosk 7 is operationally associated with a network service provider 11 such as the internet via a modem 14. Network service provider 11 permits communication, connection and image and data transfer to remote locations. More specifically kiosk 7 can be connected to the internet via modem 14, cable line, wireless connection, or any other technology designed to allow two way communication. This can enable a variety of activities including transfer of generated images to a central storage site which can be accessed by a consumer or which has the purpose of generating hardcopy or digital file output that can be sent to a consumer; exchange of information related to purchasing of services, such as credit card numbers and authorizations; exchange of information on consumer habits; download of information to the kiosk for update of operating systems, advertising banners, modifications of behavior to compensate for recently released films; upload of information to a control center relating to equipment maintenance and malfunctions.

In a further feature of kiosk 7 of the present invention, kiosk 7 can be adapted to receive a cassette including exposed film. The film is preferably located in a thrust cartridge. The thrust cartridge may be any cartridge that allows film to be withdrawn from the cartridge and rewound onto the cartridge multiple times while providing light-tight storage, particularly prior to exposure and development. Typical of such cartridges are those utilized in the advanced photo system (APS) for color negative film. These cartridges are disclosed in U.S. Pat. No. 4,834,306 to Robertson et al. and U.S. Pat. No. 4,832,275 to Robertson.

Already cited U.S. Pat. No. 6,048,110, and U.S. Pat. No. 6,062,746 illustrate a further example of an apparatus for thermal development of thermal film using a thrust cartridge, with the apparatus including a magnetic reader and writer and a scanner.

Figure 2A:
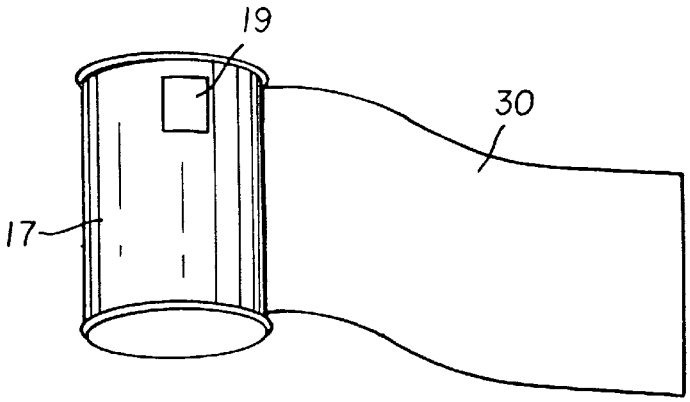
FIGS. 2A–2D illustrate features of film cassettes and film in accordance with the present invention.
Figure 2B:
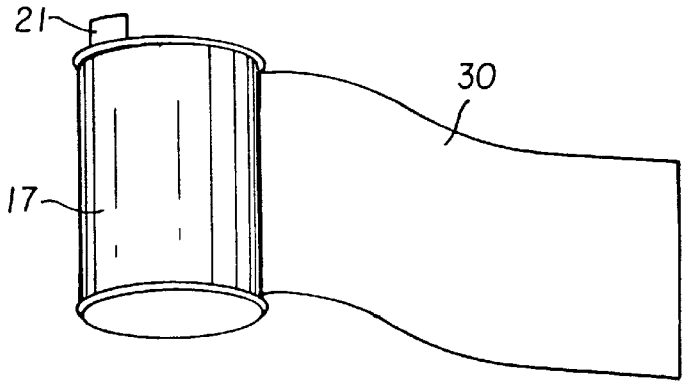
Figure 2C:
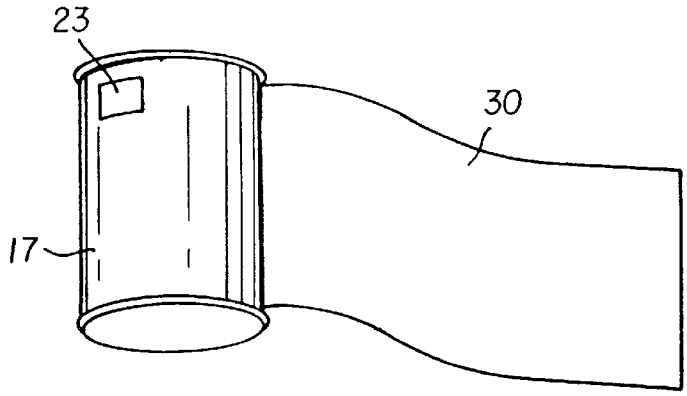
Figure 2D:
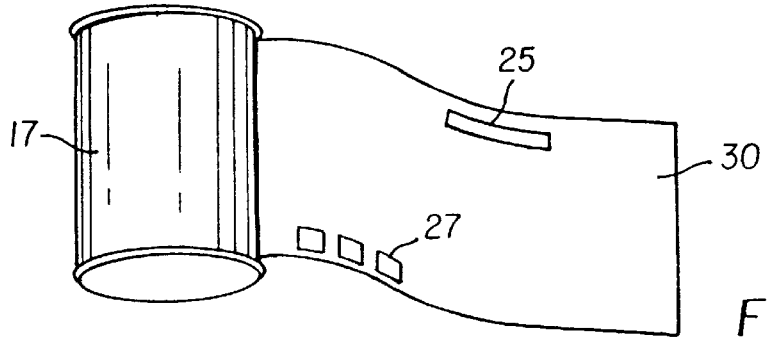

In a further feature of the invention, kiosk 7 can be adapted to receive a thrust cartridge in which a prepay identifier is placed on the film cassette. A preferred implementation of this system for a thermal film would be to allow the consumer to pay for processing at the time of film purchase. This would have the advantage of simplifying the design of kiosk 7 and its operating system by removing the need for a payment transaction. It would also provide enhanced and quicker operation for a consumer. With reference to FIGS. 2A–2D, this system would involve marking a cassette 17 to indicate that the processing has been prepaid. This marking could take the form of (1) a printed element 19 on cassette 17 as shown in FIG. 2A; (2) a feature in the design of the cassette, such as the cassette shape or color; (3) a mechanical component 21 of cassette 17 as shown in FIG. 2B; (4) an electronic component 23 on cassette 17 as shown in FIG. 2C; or (5) a marking or recording 25 on film element 30 contained in cassette 17 as shown in FIG. 2D. Printed element 19 (FIG. 2A) on cassette 17 could be a bar code and id number or some other human readable or machine readable information source. Mechanical component 21 (FIG. 2B) could be a lever or other mechanical device indicating that the processing is prepaid. Electronic component 23 (FIG. 2C) could take the form of an electrically readable device ranging from electrical contacts (similar to DX coding) to a more sophisticated electronic device using semiconductors and microprocessing, such as a smart chip. Marking or recording 25 (FIG. 2D) on film element 30 could take the form of recorded information on film magnetics (when present), optical information recorded on the processed film, or notches or perforations 27 (FIG. 2D) on film element 30 indicative of prepaid status. Cassette 17 may have several indicators of being prepaid, so that the state is human and machine readable. The use of redundant indicators, some of which are not human readable, would also serve to deter misuse of the system. The code, identifier or id can additionally be employed as described in U.S. patent application Ser. No. 09/456,613 to Szajewski et al., filed Dec. 8, 1999.

In a further feature of the present invention, thermal film processing kiosk 7 can be enabled to receive single use cameras and process film therein. In this implementation, kiosk 7 would include an entry port 35 (FIG. 1) adapted to receive a single use camera having exposed thermal film. Kiosk 7 would include an apparatus designed to remove or extract the film from the cassette in a specially designed one time use camera, and process it in accordance with the consumer request as input to touchscreen 9. One time use cameras containing dry-process films are described by Kamata in Japanese Kokai 11/237,682. One time use cameras designed for easy mechanical removal of imagewise exposed film are described by Zander in U.S. Pat. No. 5,799,220 and by Zander et al. in U.S. Pat. No. 5,903,789. Well known apparatuses for automatically extracting exposed camera formatted films from cartridges or cassettes for chemical processing are described in cited U.S. Pat. Nos. 5,113,351 and 5,627,016.

Kiosk 7 can be physically configured as a robust stand alone unit (such as required by a commercial arcade game or automatic teller machine) or as a tabletop interface (such as required for a library personal computer or Internet connection). The components most likely to be bundled within a single physical box are the film cartridge, handling mechanism or cassette acceptor, the film thermal processor, and the film scanner. The remaining components may optionally be contained within the same box or as separate, free standing units. These remaining components, separate from those components that should specifically contact the film and/or cartridge, are the image viewing screen (touch screen, video CRT, compact flat panel LCD), the customer interaction device (touch screen, keyboard, voice activated sensor) the central computer processing unit (personal computer, remote networked computer, Internet server), the output printer (ink jet, thermal dye transfer, photo processing digital minilab), the payment transaction device (credit/debit card reader, cash or token acceptance device), a second scanning station (film driven scanner, flatbed scanner), storage medium (floppy disk, compact disk writer, Internet image upload), or the central communication device (modem, cable line, wireless connection). One advantage of employing a pre-paid cassette is that security and/or fraud associated with the kiosk could be minimized, allowing more user or vendor freedom. In the case of a tabletop interface, all of the non-film contacting components could optionally be used for other tasks by the user or proprietor, including Internet connection, personal computer software, business invoicing, video games, and the like.

Figure 3:
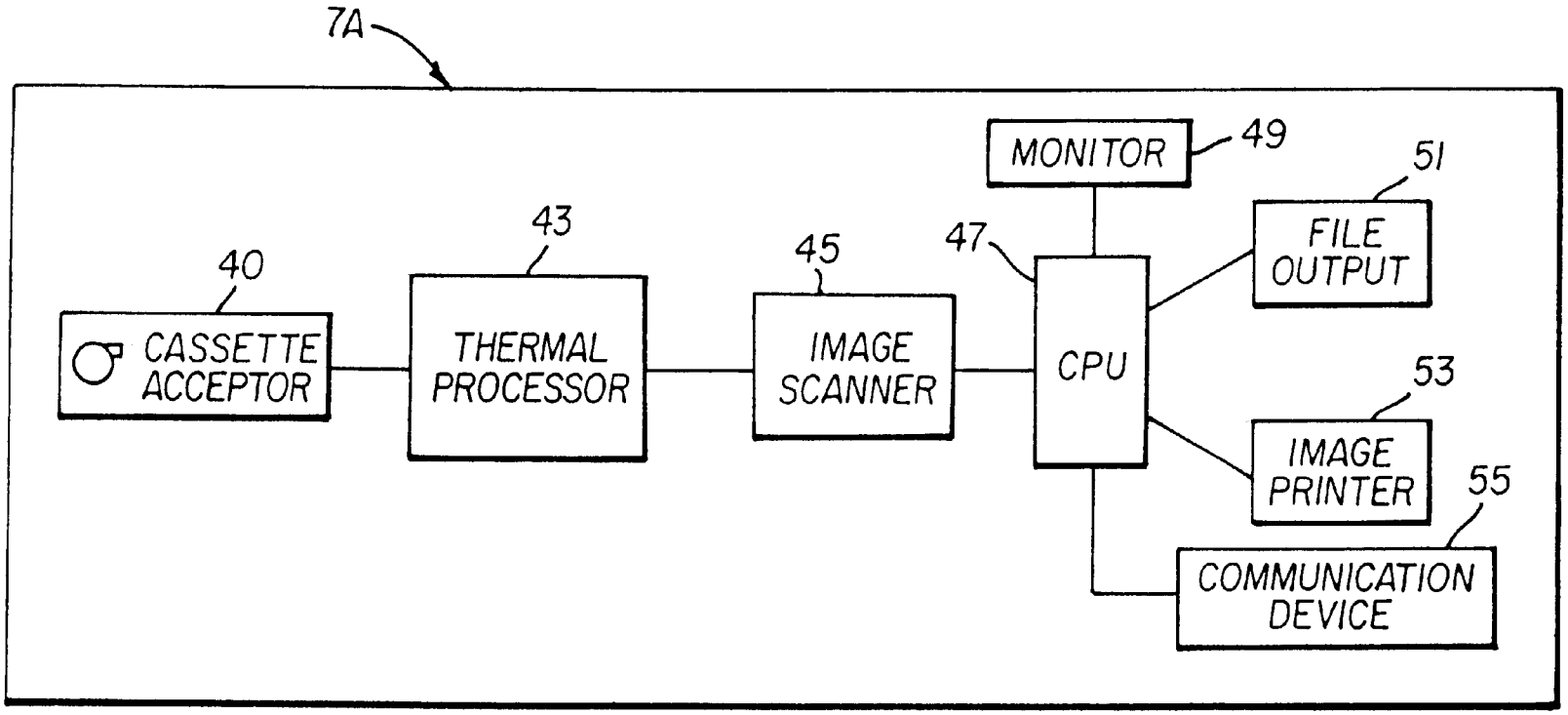
FIG. 3 illustrates features of a thermal kiosk processor.
Figure 4:
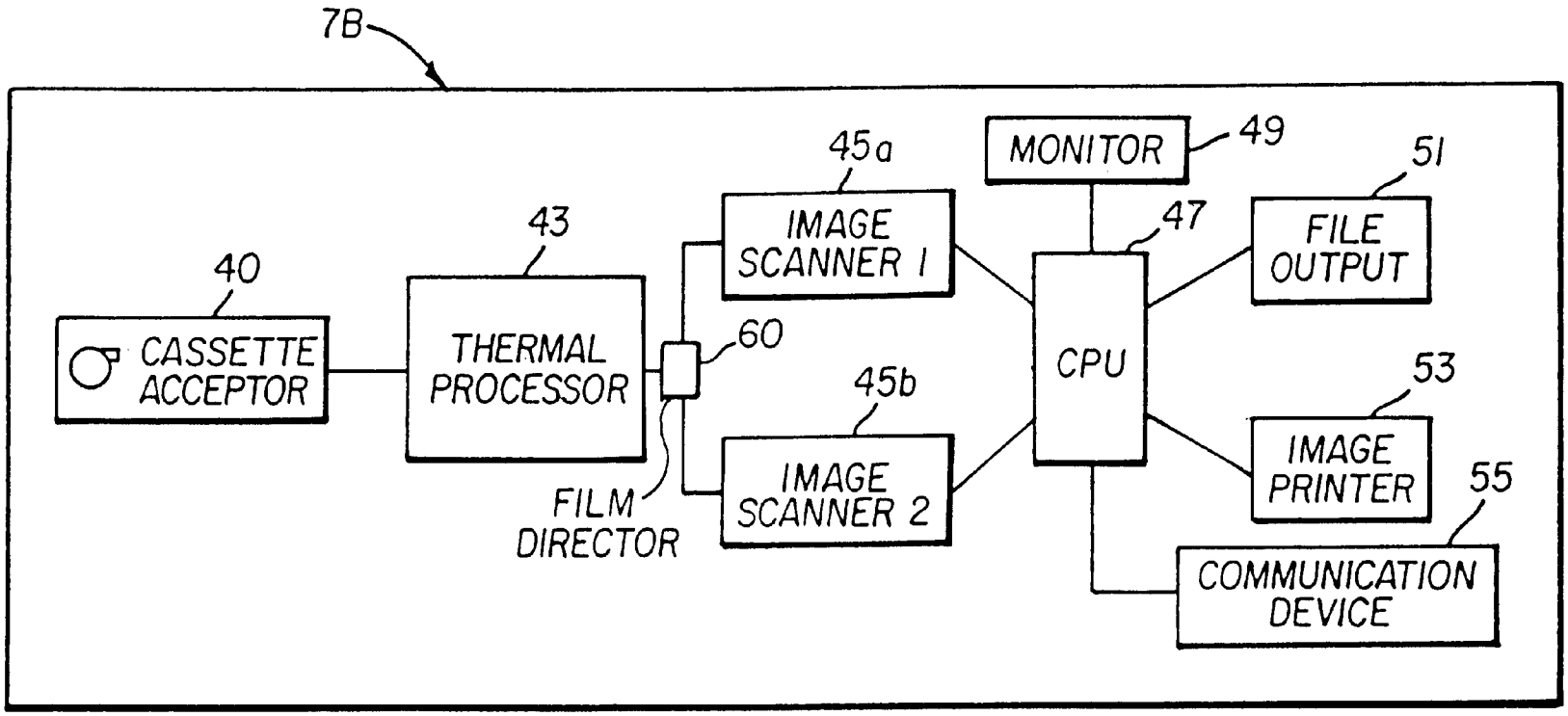
FIGS. 4–5 illustrate further examples of thermal kiosk processors in accordance with additional features of the present invention.
Figure 5:
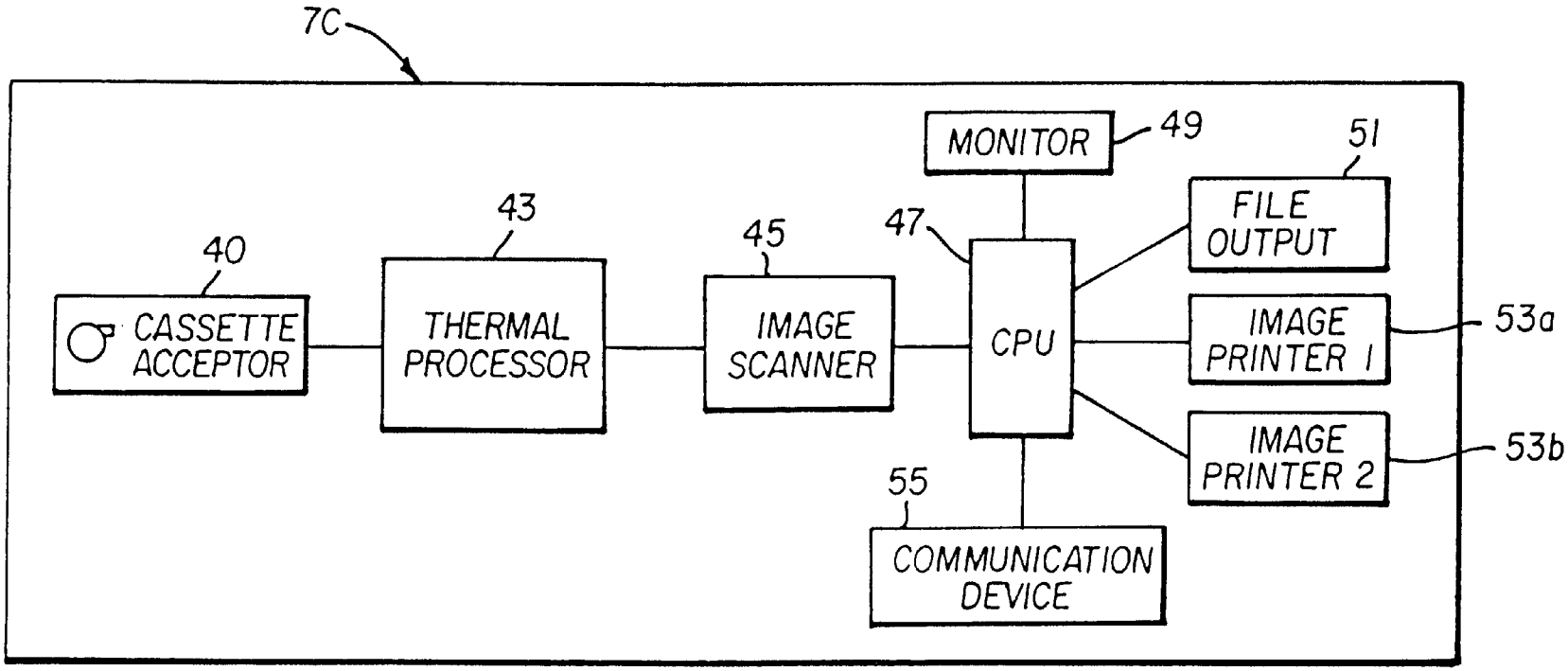

FIGS. 3–5 illustrate examples of processing workflows in thermal film processing kiosk 7, in which kiosk 7 can employ multiple channels to improve throughput.

In thermal processing kiosks 7A, 7B and 7C illustrated respectively in FIGS. 3–5, an aim is for consumers to be able to gain rapid access to their images. As shown in FIG. 3, kiosk 7A contains at least the following: a cassette acceptor 40 to accept a film cassette and extract film so that it can be manipulated; a thermal processor 43 to thermally process the film; an image scanner 45 to scan and digitize the images generated on the thermally processed films; a central processing unit (CPU) 47 to digitally process the scanned images so as to provide a suitable digital file; a monitor 49 on which to view the images and the progress/status of the film processing; a printer 53 to print the digital files thus rendering a hardcopy output; a file output or digital file writer 51 such as a compact disc writer or a floppy disc writer to deliver a digital file output; and an electronic communication device 55 so that kiosk 7A can communicate with other computers, for instance using the world wide web or Internet.

The thermal process of thermally developable film in accordance with the present invention typically involves the application of heat to thermal film. Thermal processor 43 can include a heater, which can be any suitable type of heater. For example, the heater can be a resistive heater in the form of a plate or drum, a radiant heater, heated liquid, dielectric, microwave conduction and convection. Reference is made to already cited U.S. Pat. Nos. 6,048,110 and 6,062,746 (the contents of which are herein incorporated by reference) for a description of a thermal processing system and thermal film.

In another embodiment, the apparatus can thermally process supplied films by the application of heated gasses or heated air. Specific examples of such a method and the associated apparatus are disclosed by: Siryj U.S. Pat. No. 4,371,246; Goldberg et al., U.S. Pat. No. 4,358,192; Siryj et al., U.S. Pat. No. 4,293,212; Scott, U.S. Pat. No. 4,198,145; Quantor, U.S. Pat. No. 4,052,732; Siryj, U.S. Pat. No. 4,148,575 and Limoges, Research Disclosure, 176,023 (1978). Alternatively, radiant energy as disclosed by Chin et al. U.S. Pat. No. 5,587,767 can be employed.

In another embodiment, the heated gases can be loaded with particles to form a heated fluidized bed for thermally processing the photothermographic film. In this embodiment, the particles in the fluidized bed can serve to both transfer heat energy to the film and can serve to abrade dirt from the film surface during processing.

As is the case with typical mechanical systems attempting to achieve a high processing speed, some or all of the components illustrated in FIG. 3 may be rate limiting in the processing and output of film images. In that case, it is desirable to have a dual or multiple channel of processing to improve the output of those elements that would be rate limiting. FIGS. 4 and 5 illustrate two embodiments which address the issue of potential rate limiting components in a thermal processing kiosk in accordance with the present invention.

In the embodiments of FIGS. 4 and 5, those elements which correspond to the elements in FIG. 3 have the same reference numerals. The embodiment of FIG. 4 illustrates a thermal processing kiosk 7B in which image scanning is a rate limiting process. The rate limiting process is addressed or eliminated by employing two scanners 45*a* and 45*b* in place of the single scanner 45 of FIG. 3. Kiosk 7B of FIG. 4 also includes a film direction hardware 60 which is adapted to direct processed film to one scanner (45*a* or 45*b*) or the other as needed.

The embodiment of FIG. 5 illustrates a thermal processing kiosk 7C in which image printing is a rate limiting process. The rate limiting is addressed or eliminated by employing two printers 53*a*, 53*b* in place of the single printer 53 of FIG. 3. In this case, selection of the printer (53*a*, 53*b*) can be handled simply by selection within CPU 47, with both printers 53*a*, 53*b* having access to a common CPU. This version can contain optional hardware to bring printed images to the same location, such as in the case where the printed images are loaded into an envelope prior to pickup by the consumer. Of course the present invention is not limited to the configurations for addressing rate process limitations as shown in FIGS. 4 and 5. For example, depending on volume of work and type of output, the kiosk can include two scanners and two printers, three scanners and one printer or any combination of scanners and printers which are adequate to address the rate limiting process.

In a further feature of the thermal processing kiosk in accordance with the present invention, provision is made to employ a low resolution prescan for implementation of a process in which a consumer can preliminarily select a photo (Photoselect mode).

More specifically, thermal kiosk 7 of the present invention provides for a photographic process in which preliminary processed images appear in a very short time frame on a soft display 75 (FIG. 1). This allows the consumer to select which images are ultimately printed as well as select crop, zoom, and other features by way of touch screen 9. The photoselect mode can be implemented in the thermal processing kiosk in two modes. In mode 1, two scanners 53*a*, 53*b* as illustrated in FIG. 4 would be used. One of the two scanners 53*a*, 53*b* would yield a lower quality scan immediately after processing at processor 43. Images obtained from this lower quality scan are previewed or displayed on soft display 75 for the consumer, while higher quality scans are performed in the other scanner 53*a*, 53*b* in anticipation of future consumer selections. The scanning could be based on resolution, i.e. pixel number, bit depth or both. In mode 2, the same scanner (45 in FIG. 3 or 5) is used to perform both scans. The single scanner 45 would be adapted to operate in a low quality rapid mode for the preview or display, and in a higher quality slower mode for the ultimate images. This second mode would utilize appropriate hardware to pass and rewind film for the two separate scans at the single scanner.

It is further contemplated to make use of reference patches on the film. Such reference patches and methods are described in more detail by Reem et al. U.S. Pat. No. 5,667,944, Wheeler et al U.S. Pat. No. 5,649,260, Koeng at al U.S. Pat. No. 5,563,717, by Cosgrove et al U.S. Pat. No. 5,644,647, and in combination with films intended for scanning by Sowinski et al U.S. Pat. No. 6,021,277.

Once distinguishable color records have been formed in the processed photographic elements, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. If other colors are imagewise present in the element, then appropriately colored light beams are employed. A simple technique is to scan the photographic element point-by-point along a series of laterally offset parallel scan paths. A sensor that converts radiation received into an electrical signal notes the intensity of light passing through the element at a scanning point. Most generally this electronic signal is further manipulated to form a useful electronic record of the image. For example, the electrical signal can be passed through an analog-to-digital converter and sent to a digital computer together with location information required for pixel (point) location within the image. The number of pixels collected in this manner can be varied as dictated by the desired image quality. Very low resolution images can have pixel counts of 192×128 pixels per film frame, low resolution 384×256 pixels per frame, medium resolution 768×512 pixels per frame, high resolution 1536×1024 pixels per frame and very high resolution 3072×2048 pixels per frame or even 6144×4096 pixels per frame or even more. Higher pixel counts or higher resolution translates into higher quality images because it enables higher sharpness and the ability to distinguish finer details especially at higher magnifications at viewing. These pixel counts relate to image frames having an aspect ratio of 1.5 to 1. Other pixel counts and frame aspect ratios can be employed as known in the art. On digitization, these scans can have a bit depth of between 6 bits per color per pixel and 16 bits per color per pixel or even more. The bit depth can preferably be between 8 bits and 12 bits per color per pixel. Larger bit depth translates into higher quality images because it enables superior tone and color quality.

The electronic signal can form an electronic record that is suitable to allow reconstruction of the image into viewable forms such as computer monitor displayed images, television images, optically, mechanically or digitally printed images and displays and so forth all as known in the art. The formed image can be stored or transmitted to enable further manipulation or viewing, such as in Docket 81040 titled AN IMAGE PROCESSING AND MANIPULATION SYSTEM TO Richard P. Szajewski, Alan Sowinski and John Buhr.

An image scanner is used to scan an imagewise exposed and photographically processed color element. As the element is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to Digital Image Processor and the information is transformed into an electronic form R', G', and B' embodying the customer look preference, which can be stored in any convenient storage device or otherwise delivered to the customer by any convenient method. In one embodiment, it is specifically contemplated to scan a developed image to red, green and blue light to retrieve imagewise recorded information and to scan the same image to infrared light for the purpose of recording the location of non-image imperfections. When such an imperfection or "noise" scan is employed, the signals corresponding to the imperfection can be employed to provide a software correction so as to render the imperfections less noticeable or totally non-noticeable in soft or hard copy form. The hardware, software and technique for achieving this type of imperfection reduction is described by Edgar in U.S. Pat. No. 5,266,805 and by Edgar et al. in WO 98/31142, WO 98/34397, WO 99/40729, WO 99/42954. Further, the developed image can be scanned multiple times by a combination of transmission and reflection scans, optionally in the infrared and the resultant files combined to produce a single file representative of the initial image. Such a procedure is described by Edgar at U.S. Pat. Nos. 5,465,155, 5,519,510, 5,790,277, and 5,988,896, and by Edgar et al at EP-A-0 944,998, WO 99/43148, and WO 99/43149.

The invention has been described in detail with particular reference to certain preferred embodiments thereof, but it will be understood that variations and modifications can be effected within the spirit and scope of the invention.

What is claimed is:

1. A thermal processing kiosk comprising:

a user interface control for inputting information;

an opening adapted to accept a film cassette containing exposed thermal film therein;

a thermal processor for processing said exposed thermal film at least in accordance with said information to develop images on said film; and a scanner for scanning said images to create a digital image record file of said images.

2. A kiosk according to claim 1, further comprising:

a further opening adapted to accept a single use camera with exposed film therein for processing.

3. A kiosk according to claim 1, further comprising:

a monitor for viewing the images and monitoring a status of the processing at said thermal processor and said scanner;

a printer for printing a hard copy output of said images; and an electronic communication interface for downloading the images onto a network service provider.

4. A kiosk according to claim 1, comprising a further scanner and a film direction controller for directing the processed film to either said scanner or said further scanner based on a work flow in said scanner and said further scanner.

5. A kiosk according to claim 1, comprising at least one printer for printing hard copy outputs of said images.

6. A kiosk according to claim 1, wherein said kiosk has a photo select mode and comprises an image display to permit a preview of preliminary processed images, such that in said photo select mode the user can select which images are to be printed.

7. A kiosk according to claim 6, comprising a further scanner, such that in said photo select mode, one of said scanner or said further scanner provides a lower quality scan immediately after processing to obtain images for display on said image display, and the other of said scanner or said further scanner provides a higher quality scan for printing.

8. A kiosk according to claim 6, wherein in said photo select mode, said scanner performs a lower quality scan to obtain images for display on said image display and a higher quality scan for printing of said images.

9. A kiosk according to claim 1, wherein said film includes a reference patch.

10. A kiosk according to claim 1, wherein said film cassette includes an identifier indicating that processing has been pre-paid for the exposed film in the cassette.

11. A kiosk according to claim 10, wherein said identifier is at least one of a printed element on the cassette, a design of the cassette, a mechanical component on the cassette, a marking on the film, or a recording on the film.

12. An image processing method comprising the steps of purchasing photographic film and paying for processing of the film prior to exposure of the purchased film; and associating an identifier with the photographic film indicating that processing for the film has been pre-paid, wherein said step of associating the identifier with the film comprises providing a mark on a cassette in which the film is housed.

13. A method according to claim 12, wherein said step of associating the identifier with the film comprises providing at least one of a mechanical component or electrical component on a cassette in which said film is housed.

14. A method according to claim 12, wherein said step of associating the identifier with the film comprises providing at least one of a marking or recording on the film.

15. A method according to claim 12, wherein after exposure of said film, the method comprises the further steps of:

receiving said exposed film at a processing location;

processing said exposed film to develop images on said film; and scanning said film to create a digital record file of images on said film.

16. A method according to claim 15, wherein said processing location is a thermal processing kiosk and said film is thermal film.

17. A photographic film cassette having unexposed film therein, wherein an identifier is associated with at least one of the cassette or the film to indicate that processing for the unexposed film in the cassette has been pre-paid, wherein said identifier is at least one of a printed element on the cassette, a design of the cassette, a mechanical component on the cassette, a marking on the film, or a recording on the film.

18. A thermal processing kiosk comprising:

a user interface control for inputting information;

an opening adapted to accept a single use camera with exposed thermal film therein;

a thermal processor for processing said exposed thermal film at least in accordance with said information to develop images on said film; and a scanner for scanning said images to create a digital image record file of said images.

* * * * *